US007934334B2

(12) United States Patent
Kraft

(10) Patent No.: US 7,934,334 B2
(45) Date of Patent: May 3, 2011

(54) AIMING SYSTEMS

(75) Inventor: Timothy W. Kraft, Birmingham, AL (US)

(73) Assignee: The UAB Research Foundation, Birmingham, AL (US)

( * ) Notice: Subject to any disclaimer, the term of this patent is extended or adjusted under 35 U.S.C. 154(b) by 34 days.

(21) Appl. No.: 12/570,616

(22) Filed: Sep. 30, 2009

(65) Prior Publication Data

US 2010/0077647 A1 Apr. 1, 2010

Related U.S. Application Data

(60) Provisional application No. 61/101,362, filed on Sep. 30, 2008.

(51) Int. Cl.
*F41G 1/00* (2006.01)

(52) U.S. Cl. ..... 42/111; 42/133; 42/144

(58) Field of Classification Search ..... 42/111, 42/144, 145, 113, 133, 112, 123, 131, 132, 42/135, 139; D22/109
See application file for complete search history.

(56) References Cited

U.S. PATENT DOCUMENTS

| | | | | | |
|---|---|---|---|---|---|
| 834,143 | A | * | 10/1906 | Kokotovic | 42/111 |
| 1,350,153 | A | * | 8/1920 | Gregory | 42/133 |
| 1,358,015 | A | * | 11/1920 | Pen | 42/136 |
| 1,363,553 | A | * | 12/1920 | Barringer | 42/145 |
| 1,480,048 | A | * | 1/1924 | Davis | 42/135 |
| RE24,313 | E | * | 5/1957 | Munsey | 42/145 |
| 3,777,380 | A | * | 12/1973 | Theodore | 42/144 |
| 4,479,307 | A | * | 10/1984 | Pomeranz | 42/133 |
| 4,536,965 | A | * | 8/1985 | Tildeblad | 42/132 |
| 4,803,736 | A | | 2/1989 | Grossberg et al. | |
| 4,957,357 | A | | 9/1990 | Barns et al. | |
| 5,519,941 | A | * | 5/1996 | Yusko | 42/133 |
| 5,822,872 | A | * | 10/1998 | Waki | 42/111 |
| 6,058,616 | A | * | 5/2000 | Bubits | 42/144 |
| 6,711,846 | B1 | * | 3/2004 | Nasef | 42/130 |
| 6,769,210 | B2 | * | 8/2004 | Bubits | 42/113 |
| D515,170 | S | * | 2/2006 | Price | D22/109 |
| 7,743,546 | B2 | * | 6/2010 | Keng | 42/145 |
| 7,832,138 | B1 | * | 11/2010 | Price | 42/144 |

OTHER PUBLICATIONS

Owner's Manual and Instructions for Use, Steyr M-$A_1$ Pistol, Steyr Arms Inc, Steyr Mannlicher, pp. 1-65, 2005.

* cited by examiner

*Primary Examiner* — Michelle Clement
(74) *Attorney, Agent, or Firm* — McKeon Meunier Carlin Curfman

(57) ABSTRACT

Provided herein are systems for aiming devices. For example, the aiming systems can be used to aim a firearm. The aiming systems can comprise a front sight portion having a cross-section with a truncated triangle shape when viewed by an operator aiming the device. The aiming systems can further comprise a rear sight portion including a notch having a truncated triangle shape with a base, a left side, a right side, and an opening that is narrower than the base. The front sight portion is alignable relative to the notch for aiming the device.

15 Claims, 5 Drawing Sheets

AIMING SYSTEMS

CROSS REFERENCE TO RELATED APPLICATIONS

This application claims the benefit of U.S. Provisional Application No. 61/101,362, filed Sep. 30, 2008, which is incorporated by reference in its entirety as part of this application.

BACKGROUND

Accurate aiming of a device can be critical to that device's desired performance. For example, accurate and quick aiming of a firearm can make the difference between life and death for a solider, law enforcement officer, or self-defending citizen. Standard iron sights used on many firearms require a visual attention scan of four different areas on the sight when aiming. Alignment of these common sights requires (1) positioning of the front sight blade within the rear notch; (2) alignment of the top of the front sight blade with the top of the rear sight; (3) equalization of the left and right spaces on either side of the front sight within the notch, and (4) centering of the target above the front sight. These steps slow accurate firearm aiming, which may place the firearm operator at risk of bodily harm or death.

SUMMARY

Provided herein are systems for aiming devices. For example, the aiming systems can be used to aim a firearm. The aiming systems can comprise a front sight portion having a cross-section with a truncated triangle shape when viewed by an operator aiming the device. The aiming systems can further comprise a rear sight portion including a notch having a truncated triangle shape with a base, a left side, a right side, and an opening that is narrower than the base. The front sight portion is alignable relative to the notch for aiming the device.

The details of one or more aspects of the devices, systems and methods are set forth in the accompanying drawings and the description below. Other features, objects, and advantages will be apparent from the description and drawings, and from the claims.

DETAILED DESCRIPTION

The following detailed description should be read with reference to the drawings in which similar elements in different drawings are numbered the same. The drawings, which are not necessarily to scale, depict illustrative aspects and are not intended to limit the scope of what is claimed.

Figure 1A:
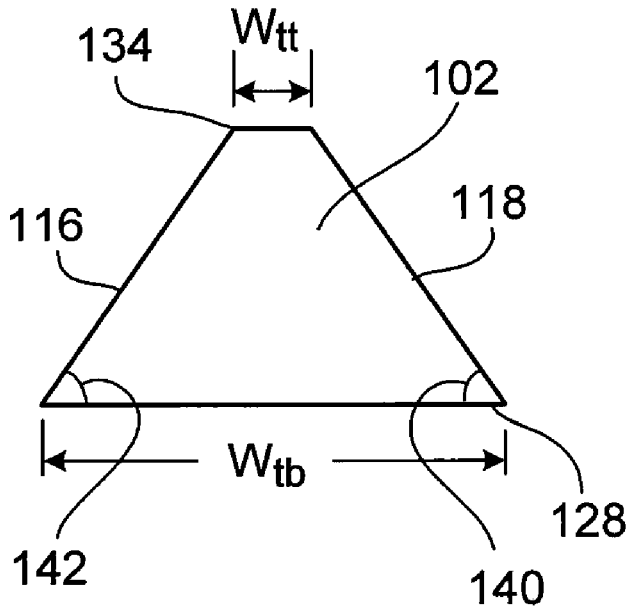
FIG. 1A is a schematic diagram illustrating aspects of an example front sight portion of a system for aiming a device.

Provided herein are systems for aiming devices. For example, the aiming systems can be used to aim a firearm. Referring to an example system for aiming a firearm, an aiming system can comprise a front sight portion and a rear sight portion. FIG. 1A is a schematic illustration of an example front sight portion 102 and FIG. 1B is a schematic illustration of an example rear sight portion 104.

Figure 2:
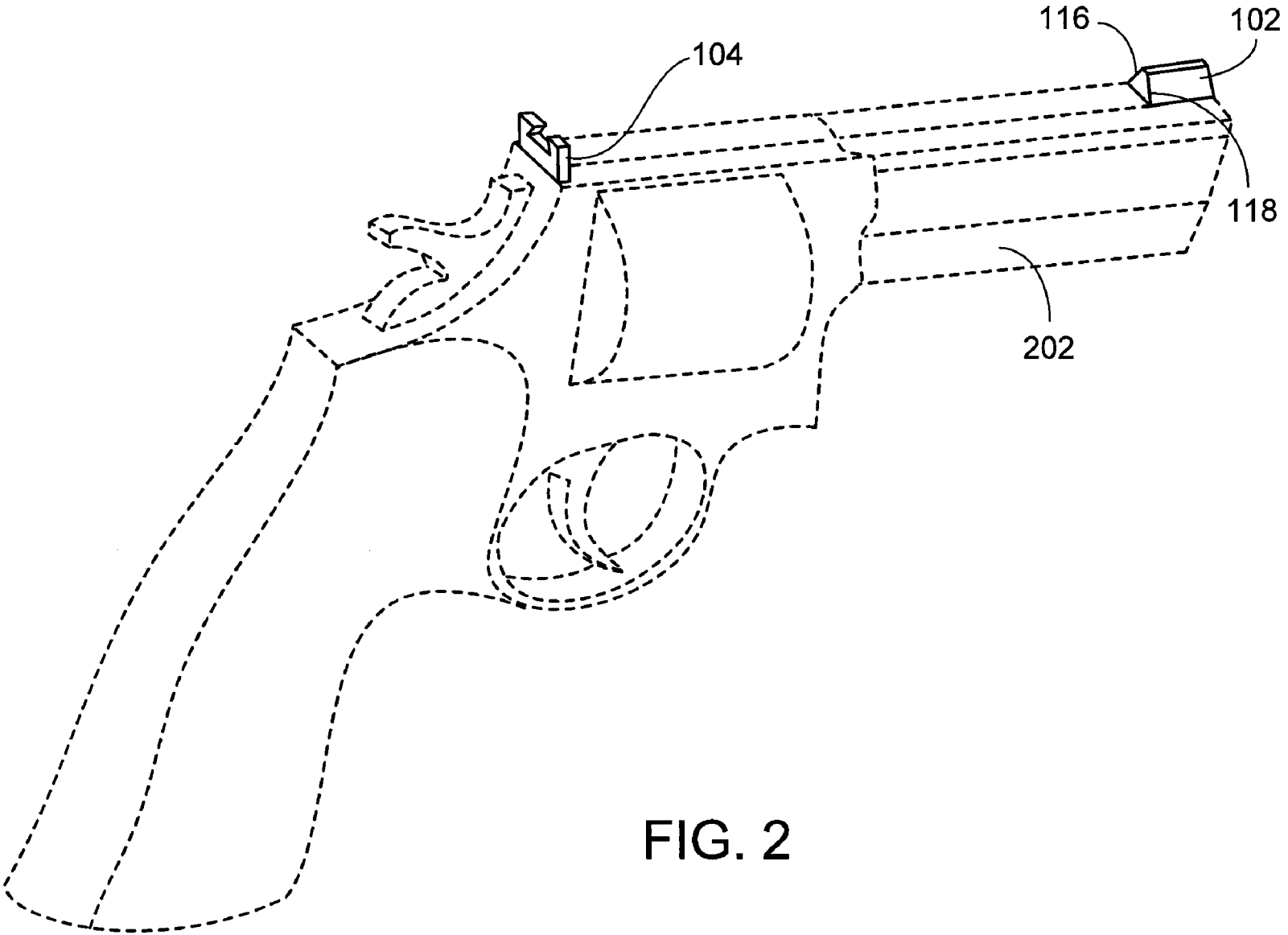
FIG. 2 is a schematic perspective diagram illustrating alignment of an example front sight portion and an example rear sight portion positioned on a firearm.
Figure 3:
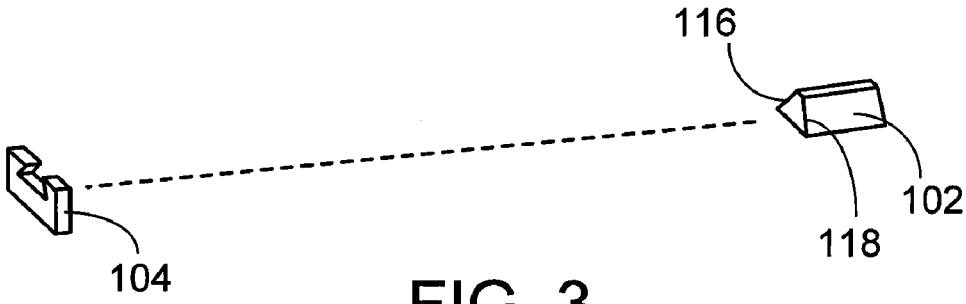
FIG. 3 is a schematic perspective diagram illustrating alignment of an example front sight portion and an example rear sight portion of an example system for aiming a device.

As shown in FIG. 2, the front sight portion 102 and rear sight portion 104 can be located on a firearm 202. The front sight portion 102 can be located on a firearm 202 in a position proximal to a target when compared to the rear sight portion 104, and the front sight portion 102 can be aligned with the rear sight portion 104 for aiming the firearm as is typical with notch and post firearm sighting systems. FIG. 3 is a schematic perspective view showing alignment of a front sight portion 102 and a rear sight portion 104.

Referring again to FIG. 1A, the front sight portion has a cross-section with a truncated triangle shape when viewed by an operator aiming the firearm. The truncated triangle cross section has a left side 116, a right side 118, a top surface 134, and a base 128. The base 128 can be formed by a surface of the firearm 202 on which the front sight portion 104 is located. The truncated triangle cross section also comprises a left base angle 142 and a right base angle 140. Optionally, the left side 116 and right side 118 are of equal length, and the left base angle 142 and right base angle 140 are equal, forming a truncated triangle shape that appears as an isosceles trapezoid to an operator aiming a firearm on which the front sight portion is located.

Figure 1B:
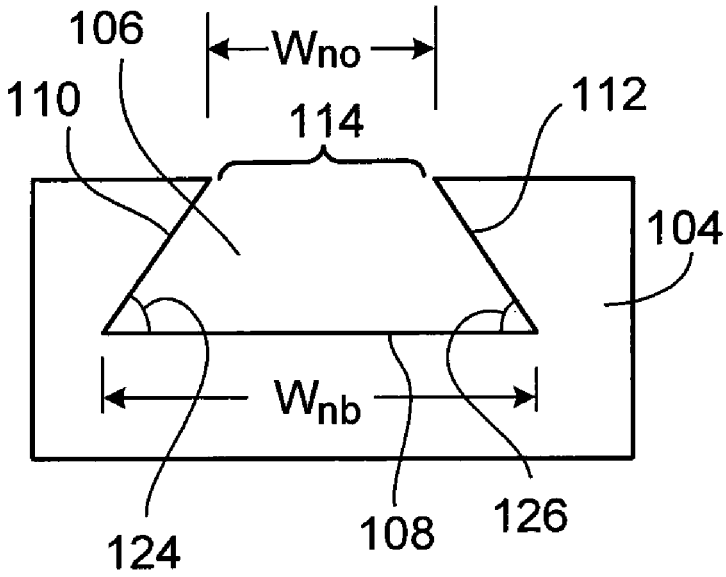
FIG. 1B is a schematic diagram illustrating aspects of an example rear sight portion of a system for aiming a device.

The rear sight portion 104 shown in FIG. 1B comprises a notch 106. The notch has a truncated triangle shape with a left side 110, a right side 112, a base 108 and an opening 114. The base 108 of the notch can be formed by a surface of the firearm 202 on which the rear sight portion 104 is located. The width of the notch base $W_{nb}$ is greater than the width of the notch opening $W_{no}$ when viewed by an operator aiming the firearm. Optionally, the left side 110 of the notch and the right side 112 of the notch are equal in length, and the angle 124 between the left side 110 and the base 108 and the angle 126 between the right side 112 and the base 108 are equal.

Figure 4:
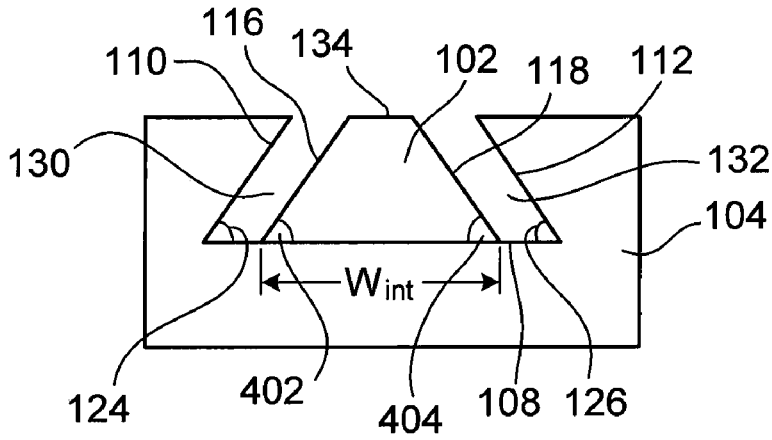
FIG. 4 is a schematic diagram illustrating alignment of an example front sight portion and an example rear sight portion of an example system for aiming a device.

As shown in FIG. 4, when aligning the front sight portion 102 with the rear sight portion 104, the front sight portion 102 can be visually positioned within the notch 106 of the rear sight portion 104. Optionally, the front sight portion 102 and rear sight portion 104 can be aligned such that when viewed by an operator aiming the firearm, the left side 110 of the notch 106 is parallel to the left side 116 of the truncated triangle shape of the front sight portion 102, and such that the right side 112 of the notch 106 is parallel to the right side 118 of the truncated triangle shape of the front sight portion 102. The base angles of the front sight portion (140 and 142) can be equal to the base angles of the notch (124 and 126). Similarly, the angles (402 and 404) created by the visual intersection of the notch base 108 with the front sight portion 102 at any given height of the front sight portion 102 can be equal, and can be equal to the angles 124 and 126.

As shown in FIGS. 1A and 1B, the width $W_{nb}$ of the notch base 108 can be greater than the width $W_{tb}$ of the base 128 of the truncated triangle shape of the front sight portion. As shown in FIG. 4, the width $W_{nb}$ of the notch base 108 can be also be greater than the width $W_{int}$ of the truncated triangle shape of the front sight portion 102 at the level at which the notch base appears to intersect the truncated triangle shape of the front sight portion (e.g. the visual intersection) when viewed by an operator aiming the firearm. Again referring to FIGS. 1A and 1B, the width of the notch opening $W_{no}$ can also be greater than the width of the top of the truncated triangle shape of the front sight portion $W_{tt}$.

Figure 5:
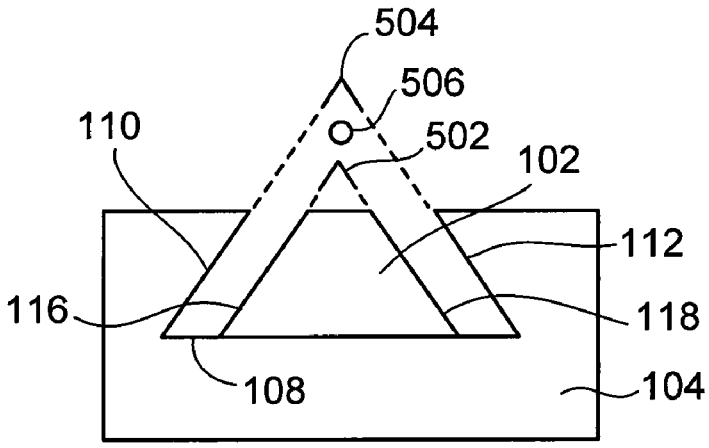
FIG. 5 is a schematic diagram illustrating alignment of an example front sight portion and an example rear sight portion and showing apexes perceived by an operator aiming a device using the front sight portion and the rear sight portion.

As shown in FIGS. 4 and 5, when the right side 112 of the notch and the right side 118 of the front portion are parallel, and when the left side 110 of the notch and the left side 116 of the front portion are parallel, and when the front sight portion 102 is aligned within the notch 106 of the rear sight portion for aiming the firearm, gaps (130 and 132) appear to an operator of the firearm between the left side 116 of the truncated triangle shape and the left side 110 of the notch and between the right side 118 of the truncated triangle shape and the right side 112 of the notch.

Figure 6:
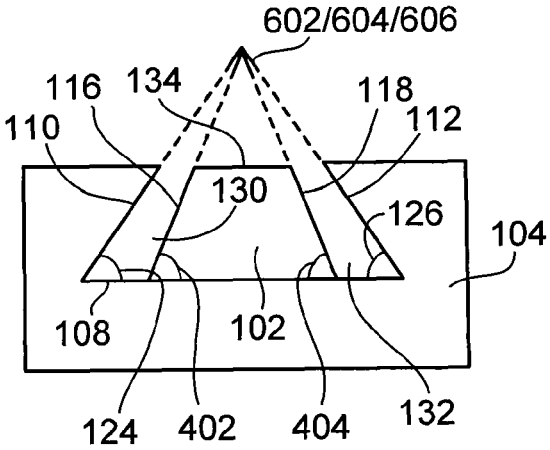
FIG. 6 is a schematic diagram illustrating alignment of an example front sight portion and an example rear sight portion and also showing apexes perceived by an operator aiming a device using the front sight portion and the rear sight portion.
Figure 7:
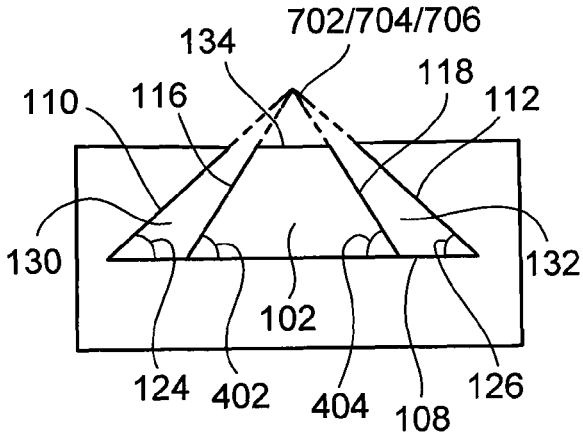
FIG. 7 is a schematic diagram illustrating alignment of an example front sight portion and an example rear sight portion and also showing apexes perceived by an operator aiming a device using the front sight portion and the rear sight portion.

Optionally, the left side 116 of the truncated triangle shape of the front sight portion 102 and the left side 110 of the notch 106 are not parallel, and the right side 118 of the truncated triangle shape of the front sight portion 102 and the right side 112 of the notch 106 are not parallel. With this non-parallel configuration, the slopes of the notch sides (110 and 112) can be more shallow than the slopes of the left and right sides (116 and 118) of the front sight portion as shown in FIGS. 6 and 7. In this regard, the left and right base angles (142 and 140) of the truncated triangle of the front sight portion 102 can be greater than the left and right base angles (124 and 126) of the notch 106. Similarly, the left and right angles (402 and 404) formed at the visual intersection of the front sight portion 102 and rear sight portion 104 can be greater than the left and right base angles (124 and 126) of the notch. When the sides are not parallel, gaps appear (130 and 132). However, the gaps appear wider proximal to the base of the notch and narrower more distal from base of the notch as shown in FIGS. 6 and 7.

The truncated triangle shape of the front sight portion 102, and the notch 104, which also has a truncated triangle shape when viewed by an operator of a firearm, both visually generate a triangle apex to an operator of the firearm. Thus, an operator of the firearm visually perceives a compete triangle formed by the front sight portion, even though only a partial representation of a full triangle, the truncated triangle shape of the front sight portion 102, is actually viewed by the operator. Similarly, the operator of a firearm visually perceives a complete triangle formed by extension of the left 110 and right 112 sides of the notch, even though only a partial representation of a full triangle, the truncated triangle shape of the notch, is actually viewed by the operator.

Thus, the shape of the front sight portion and rear sight portion present the operator aiming a firearm with the sight system a visual perception of an apex 502 of the front sight portion 102 and an apex 504 of the rear sight portion 104, although such apexes (502 and 504) actually do not exist structurally in the aiming system.

As shown in FIG. 5, optionally, the perceived apex 502 created by the front sight portion 102 can appear lower than the perceived apex 504 created by the rear sight portion 104. In this configuration, the operator visually positions the aiming system such that a target to be fired upon is located in an aiming area 506 between the perceived apex 502 and the perceived apex 504. By doing so, the operator aims the firearm at the target and the projectile from the firearm is directed to the targeted position sighted in the aiming area 506.

As shown in FIG. 6, optionally, the perceived apex 602 created by the front sight portion 102 appears at the same location as the perceived apex 604 created by the rear sight portion 104. In this configuration, the operator positions the aiming system such that a target to be fired upon is located in an aiming area 606 located at the perceived apex of the front sight portion 602, which coincides with the perceived apex of the rear sight portion 604. By doing so, the operator aims the firearm at the target and the projectile from the firearm is directed to the targeted position sighted in the aiming area 606.

As shown in FIG. 7, optionally, the perceived apex 702 created by the front sight portion 102 appears at the same location as the perceived apex 704 created by the rear sight portion. In this configuration, the operator positions the aiming system such that a target to be fired upon is located in an aiming area 706 at the perceived apex of the front sight portion 702, which coincides with the perceived apex of the rear sight portion 704. By doing so, the operator aims the firearm at the target and the projectile from the firearm is directed to the targeted position sighted in the aiming area 706.

Figure 8:
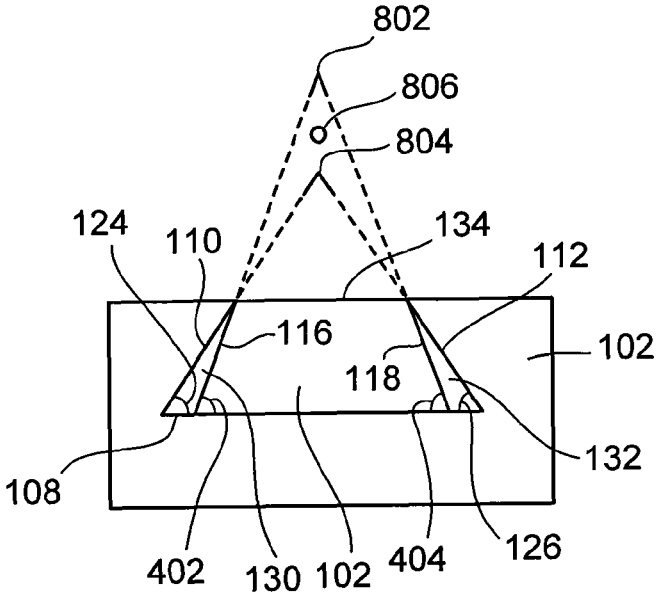
FIG. 8 is a schematic diagram illustrating alignment of an example front sight portion and an example rear sight portion and also showing apexes perceived by an operator aiming a device using the front sight portion and the rear sight portion.

As shown in FIG. 8, optionally, the perceived apex 802 created by the front sight portion 102 appears above the perceived apex 804 created by the rear sight portion 104. In this configuration, the operator visually positions the aiming system such that a target to be fired upon is located in an aiming area 806 between the perceived apex 802 and the perceived apex 804. By doing so, the operator aims the firearm at the target and the projectile from the firearm is directed to the targeted position sighted in the aiming area 806.

In the configuration shown in FIG. 7, the two perceived apexes (702 and 704) appear lower or closer to the top of the front sight portion 102 than the two perceived apexes (602 and 604) appear to the top 134 of the front sight portion 102 in the configuration shown in FIG. 6. A particular operator, or particular shooting conditions, may make it desirable to have an aiming location or area closer to the front sight portion 102 as shown in FIG. 7. Similarly, a particular operator, or particular shooting conditions, may make it desirable to have an aiming location or area further from the front sight portion 102 as shown in FIG. 6. For example, having the apexes closer to the top line 134 of the front sight portion 102 may be desired for a center hold firing style, whereas having the apexes further from the top line 134 of the front sight portion 102 may be desired for sub-6 o'clock or sub-6 hold firing style.

As described above, the front sight portion 102 can be positioned on the firearm 202 at a location proximal to a target relative to the rear sight portion 104. Firearms vary in length, and the distance between the front sight portion 102 and the rear sight portion 104, also called the sight radius, can also vary. To maintain the gaps 130 and 132 the size of the front sight portion 102 and the rear sight portion 104 can be adjusted. For example, in firearms having a larger sight radius the front sight portion 102 can be larger relative to the rear sight portion 104 than in firearms having a smaller sight radius. Moreover, the size of an image of the front sight portion 102 and the rear sight portion 104 on the retina of the operator of firearm can vary depending, for example, on the sight radius, the length of the operator's arm, the operator's arm position. Thus, the distance between the operator's retina and the front sight portion 102 and the rear sight portion 104 can vary. To compensate for these variable factors, the size of the front sight portion 102 and rear sight portion 104 can be adjusted such that each portion creates a perceived apex for an operator of the firearm. Thus, the size of the front sight portion 102 and the rear sight portion 104 can be sized relative to each other to maintain proportions that provide the aiming mechanism as described above relative to FIGS. 5-8.

Figure 9:
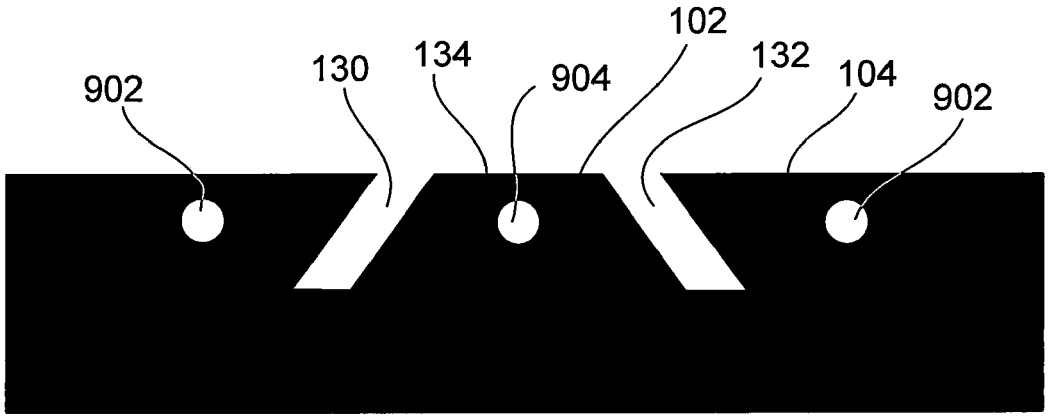
FIG. 9 is a schematic diagram illustrating alignment of an example front sight portion and an example rear sight portion of an example system for aiming a device, wherein the contrast enhancement portions are positioned on the front and rear sight portions.

FIG. 9 is a schematic diagram illustrating alignment of a front sight portion 102 and a rear sight portion 104 of an example system for aiming a device. In this example, the front and rear sight portions include contrast enhancements (902 and 904), which provide contrast with the rear sight portion and front sight portion respectively. Such contrast enhancements may be desirable when low light aiming conditions are possible or expected. Optionally, the portion of the front sight portion and rear sight portion visualized by an operator of the device when aiming can be finished in black matte and the contrast enhancements 902 and 904 can contrast with the black matte. For example, the contrast enhancements on the rear sight portion 902 and the enhancement on the front sight portion 904 can comprise a tritium insert. The contrast enhancements can also comprise high contrast paints or any other material that provides a contrast difference with the front and/or rear sight portions. As shown in FIG. 9, the contrast enhancements are optionally circular in shape when viewed by someone aiming the device. In one example, two circular dots are positioned on the rear sight portion and one is positioned on the front sight portion. Aligning the three dots can provide crude alignment and can be used when lighting conditions are poor (e.g. low light conditions). The dots can optionally comprise white paint, glow in the dark paint, or tritium. Such contrast enhancements can be used no matter the finish of the front and rear sight portions so long as they are distinguishable from the sight portions by the aimer of the device.

Figure 10:
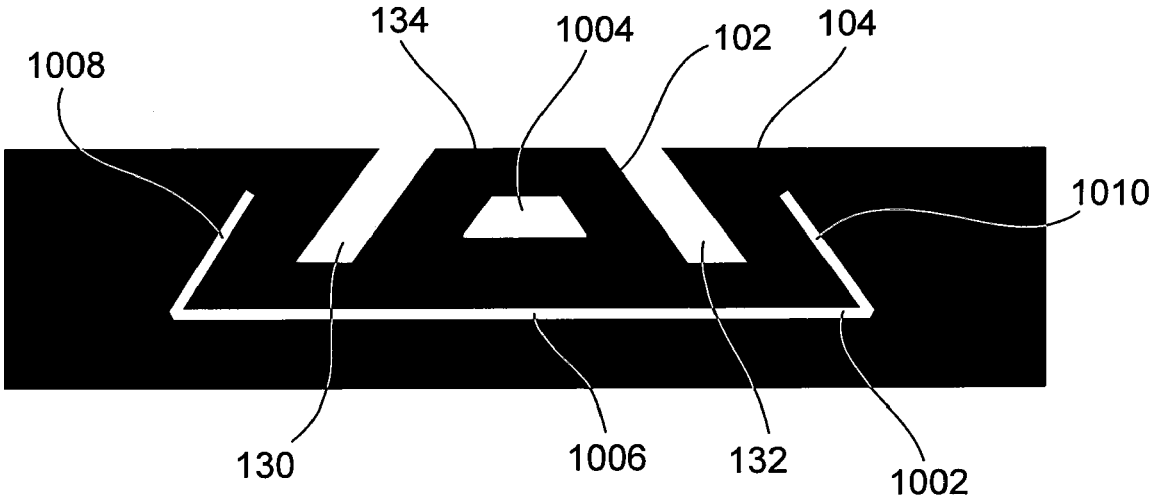
FIG. 10 is a schematic diagram illustrating alignment of an example front sight portion and an example rear sight portion of an example system for aiming a device, wherein the contrast enhancement portions are positioned on the front and rear sight portions.

As shown in FIG. 10, the front sight contrast enhancement 1004 can be shaped as a truncated triangle. Optionally, the front sight contrast enhancement 1004 can have left and right sides that are parallel to the left and right sides of truncated triangle shape of the front sight portion when viewed by a user aiming the device. Similarly, the top and bottom sides of the contrast enhancement 1004 can be parallel to the top surface 134 of the front portion and to the notch base surface 108 respectfully when visualized by an operator aiming the device. The rear sight contrast enhancement 1002 can be optionally shaped like a bracket. Optionally, the base of the bracket is parallel to and wider than the notch base. The vertical portions of the bracket can be angled relative to the bracket base at substantially the same angle as the notch angles (124 and 125). The left (1008) and right (1010) vertical portions can extend along the rear sight portion and can be parallel to the left 110 and right 112 sides of the notch respectively. The contrast enhancement shown in FIG. 10 can comprise the same types of contrast enhancing materials as described for FIG. 9. Thus, for example the contrast enhancement 1004 and 1002 can optionally be white paint, glow in the dark paint, or tritium paint. In all of these examples, the front and rear sight portions can be any color and finish such that a user can identify the contrast enhancements against the front and rear sight portions. Optionally, the device is a firearm and the front and rear sight portions are a traditional black matte finish.

The described aiming systems can also be used to aim devices other than a firearm. For example, some non-limiting examples of devices that can be aimed using the described system include the alignment of long needle biopsies, laser devices, dental x-ray aiming, aiming of optical devices such as desktop or tripod mounted telescopes, surveying equipment, or hand held micro-dish receivers like those used for recording birdsongs or conversations at a distance. In each non-firearm application, a front sight portion 102 and a rear sight portion 104 are used. The front sight portion 102 is positioned proximal to a target relative to the rear sight portion 104. Thus, a sighting system for aiming a device can comprise a front sight portion 102 and a rear sight portion 104, both positioned on the device, wherein the front sight portion 102 is positioned on the device proximal to a target at which the device is to be aimed relative to the position of the rear sight portion 104 on the device. The front sight portion 104 can have a cross-section with a truncated triangle shape when viewed by an operator aiming the device and a rear sight portion 104 can include a notch 106 having a truncated triangle shape with a base 108, a left side 116, a right side 118 and an opening 114 that is narrower than the base 108. The front sight portion 102 is alignable relative to the notch 106 for aiming the device. Thus, if the device to be aimed is a telescope, for example, a front sight portion 102 can be positioned on the telescope proximal to a target relative to a rear sight portion 104. The front sight portion 102 can be aligned relative to the notch 106 of the rear sight portion to create two apexes (e.g. 502 and 504, 602 and 604, 702 and 704, 802 and 804) perceived by the user aiming the telescope. The target can be positioned relative to the two perceived apexes as described above, with regard to a firearm, allowing for aiming of the telescope at the target.

A number of aspects of the systems, devices and methods have been described. Nevertheless, it will be understood that various modifications may be made without departing from the spirit and scope of the disclosure. Accordingly, other aspects are within the scope of the following claims.

What is claimed is:

1. An aiming system for a device, comprising:

a front sight portion having a cross-section with a truncated triangle shape when viewed by an operator aiming the device; and a rear sight portion including a notch having a truncated triangle shape with a base, a left side, a right side, and an opening that is narrower than the base, wherein the front sight portion is alignable relative to the notch for aiming the device.

2. The aiming system of claim 1, wherein the device is a firearm.

3. The aiming system of claim 1, wherein the truncated triangle shape of the front sight portion has a left side and right side of equal length and has equal left and right base angles.

4. The aiming system of claim 3, wherein the left side and right side of the notch are of equal length, and wherein the angle between the left side of the notch and the base of the notch and the angle between the right side of the notch and the base of the notch are equal.

5. The aiming system of claim 4, wherein the left side of the notch is parallel to the left side of the truncated triangle shape of the front sight portion and the right side of the notch is parallel to the right side of the truncated triangle shape of the front sight portion when viewed by the operator aiming the device.

6. The aiming system of claim 5, wherein the base of the notch is wider that the base of the truncated triangle shape of the front sight portion and the opening of the notch is wider than the top of the truncated triangle shape of the front sight portion such that gaps appear between the left notch side and the left side of the truncated triangle shape of the front notch portion and between the right notch side and the right side of the truncated triangle shape of the front notch portion when the sides are parallel as viewed by the operator aiming the device.

7. The aiming system of claim 4, wherein the left and right base angles of the truncated triangle shape of the front sight portion, the angle formed between the left side of the notch and the notch base, and the angle formed between the right side of the notch and the notch base are equal.

8. The aiming system of claim 4, wherein the left and right base angles of the truncated triangle shape of the front sight portion are greater than both the angle formed between the left side of the notch and the notch base, and the angle formed between the right side of the notch and the notch base.

9. The aiming system of claim 2, wherein an aiming point for the firearm is located between the projected apex of the truncated triangle shape of the rear sight portion and the projected apex of the truncated triangle shape front sight portion when viewed by the operator aiming the firearm.

10. The aiming system of claim 2, wherein an aiming point is located at the projected apex of the truncated triangle shape of the rear sight portion when viewed by the operator aiming the firearm.

11. The aiming system of claim 2, wherein an aiming point is located at the projected apex of the truncated triangle shape of the front sight portion when viewed by the operator aiming the firearm.

12. The aiming system of claim 2, further comprising a contrast enhancement portion positioned on the front sight portion and a contrast enhancement portion positioned on the rear sight portion, wherein each contrast enhancement portion is visually distinguishable from the sight portions by the operator aiming the firearm.

13. The aiming system of claim 12, wherein the contrast enhancement portion positioned on the front sight portion has a truncated triangle shape when viewed by the operator aiming the firearm.

14. The aiming system of claim 13, wherein the contrast enhancement portion positioned on the rear sight portion has a bracket shape having a base and left and right vertical portions, wherein the base is longer than the notch base, wherein the left vertical portion is parallel to the left notch side, and wherein the right vertical portion is parallel to the right notch side.

15. The aiming system of claim 12, wherein the rear sight portion comprises two contrast enhancement portions, the first being located left of the notch and the second being located right of the notch, and wherein the front sight portion comprises one contrast enhancement portion.

* * * * *